US006615556B2

(12) United States Patent
Cates et al.

(10) Patent No.: US 6,615,556 B2
(45) Date of Patent: Sep. 9, 2003

(54) FRAMELESS DOOR ASSEMBLY FOR CLEANROOM

(76) Inventors: Dennis O. Cates, 22985 SW. Miami Pl., Tualatin, OR (US) 97062; Roger K. Crawford, 4611 Happy Dr., Salem, OR (US) 97305

( * ) Notice: Subject to any disclaimer, the term of this patent is extended or adjusted under 35 U.S.C. 154(b) by 0 days.

(21) Appl. No.: 09/919,738

(22) Filed: Jul. 31, 2001

(65) Prior Publication Data

US 2003/0024179 A1 Feb. 6, 2003

(51) Int. Cl.[7] ..... E06B 1/04

(52) U.S. Cl. ..... 52/210; 52/204.2; 52/215; 52/281; 52/283; 52/716.8; 52/731.9; 52/734.1; 52/800.18; 49/504

(58) Field of Search ..... 52/283, 300, 465, 52/467, 468, 716.8, 731.9, 733.1, 733.2, 800.18, 281, 64.1, 213, 215, 210, 24.2, 241, 734.1; 49/504

(56) References Cited

U.S. PATENT DOCUMENTS 3,566,561 A * 3/1971 Tozer
3,690,082 A * 9/1972 Byland ..... 52/213
3,886,688 A * 6/1975 Ragland ..... 49/504
4,283,892 A * 8/1981 Brown ..... 52/213
4,625,483 A * 12/1986 Zacky et al. ..... 52/239
4,873,804 A * 10/1989 Kukke ..... 52/217
5,038,538 A * 8/1991 Rozon ..... 52/213
5,321,924 A * 6/1994 Smolik ..... 52/204.1
5,414,967 A * 5/1995 Cates et al. ..... 52/241
5,634,300 A * 6/1997 Huebner et al. ..... 52/36.1
5,806,261 A * 9/1998 Huebner et al. ..... 52/283
6,148,572 A * 11/2000 Ruff ..... 52/204.1
6,155,014 A * 12/2000 Wagner ..... 52/281
6,209,275 B1 * 4/2001 Cates et al. ..... 52/283
6,293,061 B1 * 9/2001 Horak, Jr. ..... 52/213

OTHER PUBLICATIONS

LSI Cleanromm Teecnology, The World Wide Web, Apr. 16, 2003.*
Flexible Industrial Systems, Inc. The World Wide Web, 2000.*

* cited by examiner

*Primary Examiner*—Carl D. Friedman
*Assistant Examiner*—Yvonne M. Horton
(74) *Attorney, Agent, or Firm*—ipsolon LLP

(57) ABSTRACT

The present invention provides a stud component of a cleanroom wall system that, in addition to supporting wall panels also supports a door, thereby doing away with the need for a separate, standard doorframe. Thus, the universal nature of the wall and door stud components substantially reduces the material and labor cost associated with acquiring and constructing doorframes in a cleanroom wall system.

6 Claims, 10 Drawing Sheets

Fig. 16
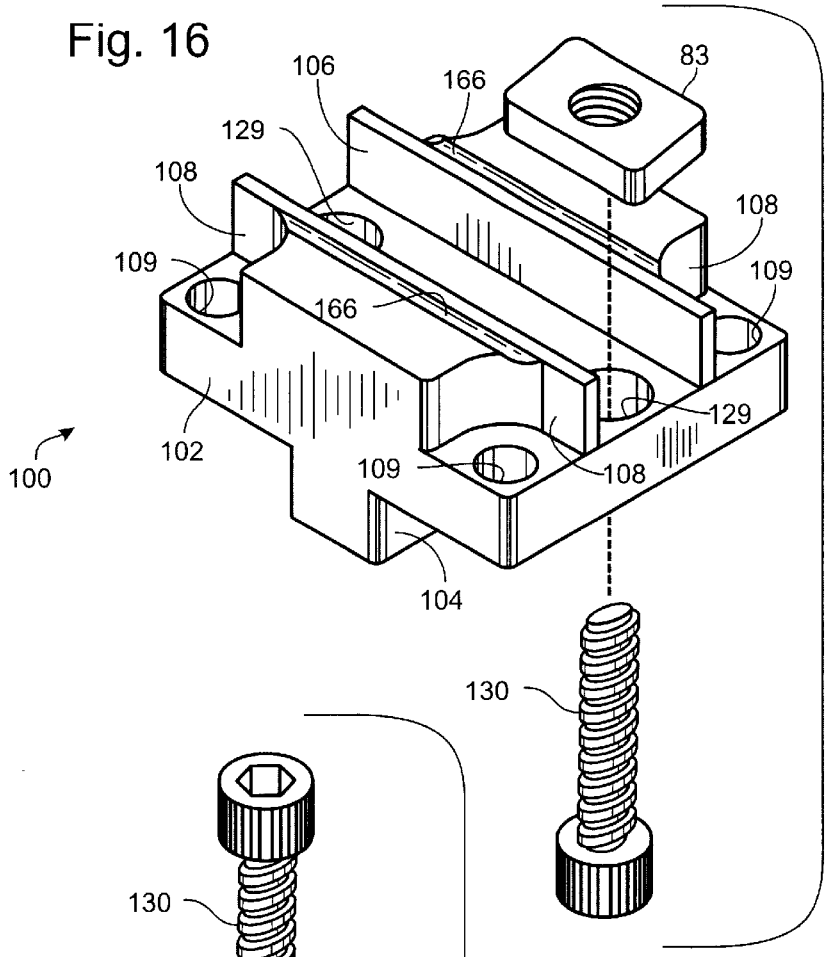
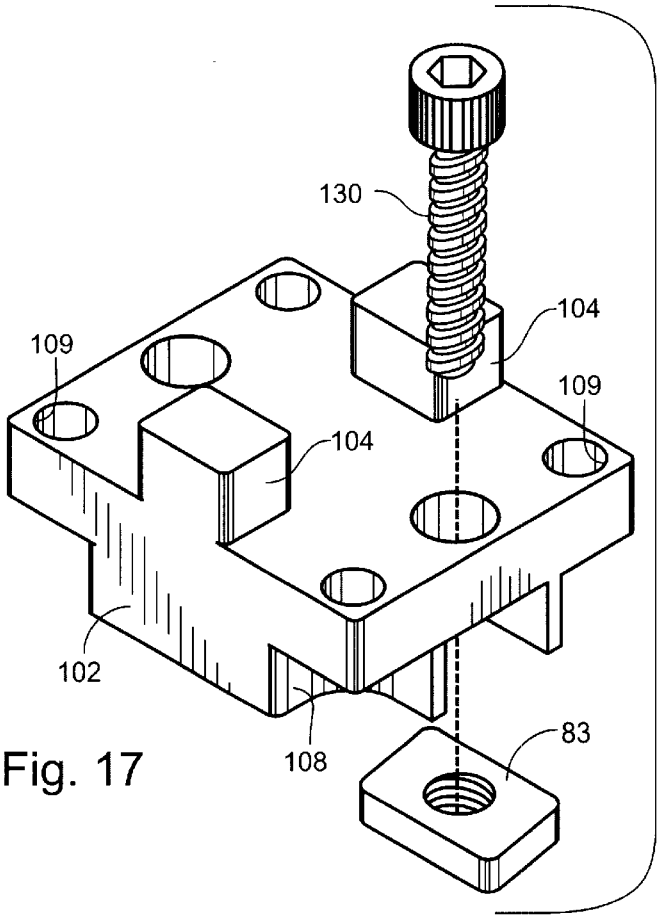
Fig. 17

FRAMELESS DOOR ASSEMBLY FOR CLEANROOM

TECHNICAL FIELD

This invention generally relates to the configuration and assembly of components that make up a wall system that is well adapted for cleanrooms, and particularly to a door assembly that does away with the need for separate doorframe components.

BACKGROUND OF THE INVENTION

Cleanrooms are commercial spaces that are constructed and maintained in a way that keeps the room free of contaminants that might otherwise interfere with the precision work undertaken there. Cleanrooms are used, for example, in the production of certain electronics and computer components.

The components of a cleanroom wall system generally include studs to which wall panels are fastened. A framework of vertical studs and interconnected horizontal studs provides sufficient stability to the overall wall system. The wall panels may be arranged in a number of ways. For instance, the panel may be a relatively thick member (hereafter referred to as a "thick" panel) that matches the nominal wall thickness and that may exceed or equal the width of the studs to which it is fastened. Alternatively, a pair of thin, spaced apart panels (spaced to match the nominal wall thickness and referred to as a "double-sided wall") may be fastened to the studs.

In yet another arrangement, single, thin-wall panels are fastened to one side of the studs, and the opposite sides of the studs are exposed. In this "single-sided wall" arrangement, it is often necessary to provide the same nominal wall thickness as provided by the previously mentioned arrangements.

In recent years the use of cleanrooms has increased dramatically. Moreover, existing cleanrooms often require rearrangement or remodeling to accommodate changes made in the production systems that are inside or adjacent to the cleanroom. Such construction and remodeling needs are best met with cleanroom wall system components that, as a result of their configuration, minimize the time and costs associated with construction and assembly of the wall system.

A significant cost savings is enjoyed when components are designed to be universal, and thus providing separate features depending on the orientation of the component. For example, U.S. Pat. No. 6,209,275 to Cates et al describes a cleanroom wall system that includes a stud component that, owing to its universal configuration, permits use of the stud with a variety of wall panel arrangements. The stud is designed to carry a batten that is easily and securely aligned with the stud and serves to secure the wall panel to the stud. That system also includes a connector block that is shaped for mounting on the end of a horizontally oriented stud and for connection with a vertical stud in a manner that ensures a stiff connection between the two studs.

SUMMARY OF THE INVENTION

The present invention is directed to the use of certain components of the cleanroom wall system mentioned above to provide a doorframe that does away with the need for a separate, standard doorframe. Thus, the universal nature of the components eliminates the material and labor cost associated with acquiring and constructing doorframes in a cleanroom wall system.

DESCRIPTION OF THE DRAWINGS

FIG. 16 is a perspective view of one side of a connector block.

FIG. 17 is a perspective view of the opposite side of the connector block of FIG. 16.

DESCRIPTION OF A PREFERRED EMBODIMENT

Figure 1:
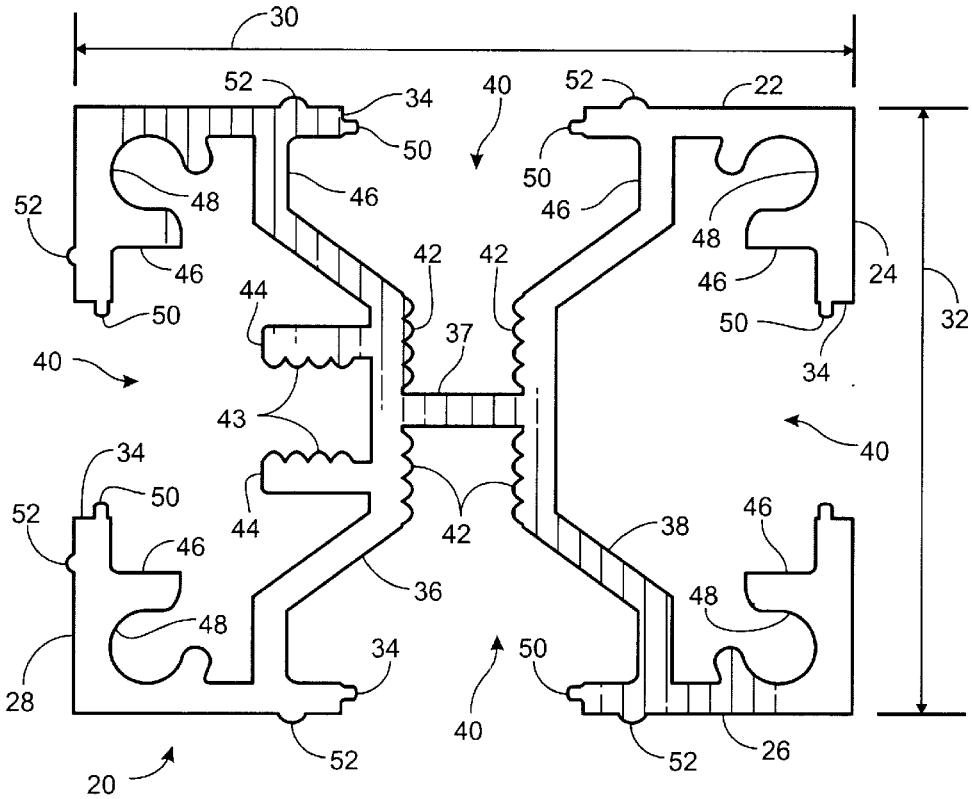
FIG. 1 is an end view of a stud component of a wall system that can be used with the assembly of the present invention.

A stud 20 for use with the frameless door assembly of the present invention is shown in a greatly enlarged end view, FIG. 1. The stud 20 is preferably extruded aluminum. The stud is rectangular in cross section and includes outer walls 22, 24, 26, 28 sized to define a wide side of the stud, indicated by dimension 30 in the figure, and a relatively narrow side 32.

Slots 34 extend along the length of the stud to interrupt each of the four outer walls of the stud. Just inside each slot 34, inner walls 36, 38, which are continuous with the outer walls, are shaped to define a chamber 40. The chambers 40 that are continuous with the slots 34 in the opposing wide-side walls 22, 26 taper toward the center of the stud. There, the inner walls 36, 38 define two parallel portions, the facing surfaces of which that are corrugated 42 to receive a threaded fastener, as explained more below. The inner walls 36, 38 are joined at the center of the stud by a web 37 that extends in a direction generally parallel with the wide sides of the stud.

One of the inner walls 36 has a pair of extensions 44 that extend into the chamber 40 toward the outer wall 28. Those extensions have corrugated inner facing surfaces 43 like the surfaces 42 just described. The chamber associated with the other, narrow-side wall 24 does not include any corrugated surfaces.

Just inside the outer wall that defines each slot 34, the stud walls are shaped to define shoulders 46. For each chamber, a pair of spaced-apart, parallel shoulders are present. The shoulder pairs are spaced apart by a distance somewhat greater than the width of the slots 34 and provide surfaces against which channel nuts bear as described more fully below.

At each corner of the stud 20 the walls are shaped to define nearly closed apertures 48 that receive sheet metal screws that are used to attach a connector block as described below.

Each of the slots 34 in an outer wall has a pair of inwardly protruding ribs 50 that are slightly thinner than the walls. As a result, the outer walls have a recessed portion lining each slot 34, thereby to accommodate, when the adjacent chamber is not utilized, a cover 82 (See FIG. 4). The cover 82 seats in the slot in a manner such that the outer surface of the cover 82 is substantially flush with the outer surface of the stud wall.

A pair of ridges 52 are associated with each of the three chambers 40 that include the corrugated surfaces 42, 43. Specifically, an elongated ridge 52 extends parallel to the length of the stud (that is, normal to the plane of FIG. 1) on both sides of the slots 34. The ridges 52 mate with correspondingly shaped grooves 66 that are formed in the batten 60 (FIG. 2), which is carried on one or more of the outer walls of the stud 20 for the purpose of securing wall panels to the stud. One will appreciate that this mating could occur with a stud that carries the grooves and the batten that carries the ridges. The ridges 52 also mate with grooves formed in the connector block 100 (FIG. 3) as will be described.

Figure 2:
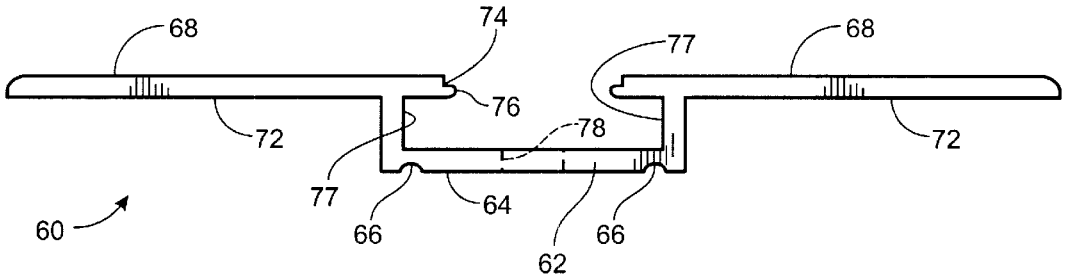
FIG. 2 is an end view of a batten component of an assembly formed in accordance with the present invention.

Turning now to FIG. 2, the batten 60 is a thin-walled, extruded aluminum member that has a generally U-shaped base 62. The underside 64 of the base rests against the outer surface of an outer wall 22, 26, 28 of the stud and includes the above-mentioned grooves 66. The grooves 66 mate with the ridges 52 on the stud thereby to facilitate correct positioning of the batten to the stud as the former is attached to the latter.

Inasmuch as the base 62 of the batten 60 rests on an outer wall of the stud 20, the overall width of a stud and batten combination represents the sum of the widths of both of those components.

The batten 60 also includes outwardly extending flanges 68. As a result, there are gaps 70 (best shown in FIG. 3) defined between the undersides 72 of the flanges of the battens and the stud outer wall to which the batten is attached. As will become clear, a wall panel or glazing may fit into this gap.

Figure 3:
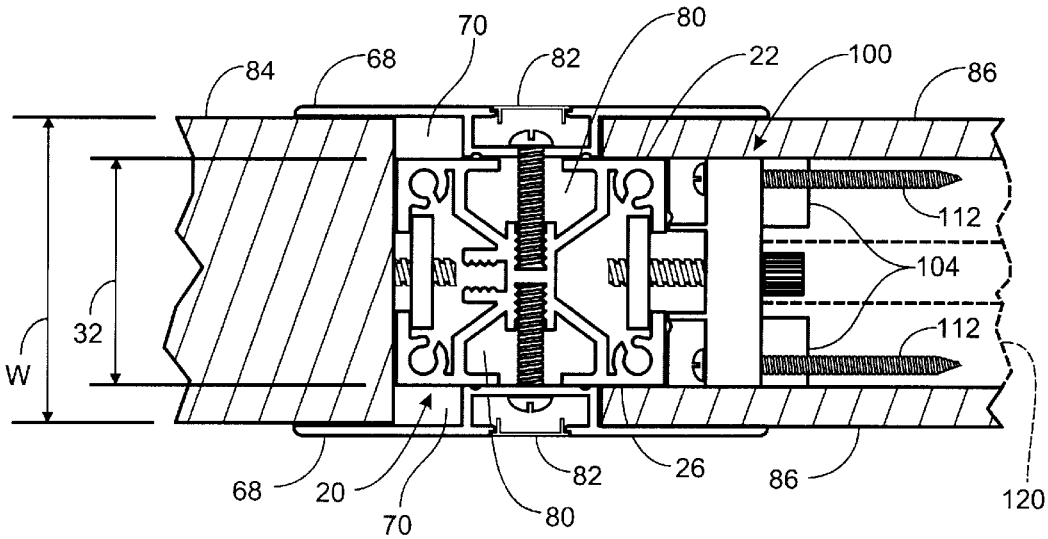
FIG. 3 is a cross sectional view of components of the cleanroom wall system at the junction of a horizontal stud and a vertical stud.

Holes 78 are formed through the base of the batten at spaced apart locations along the length of the batten. The holes 78 accommodate the shafts of screws 80 (FIG. 3). The screws 80 are threaded between the corrugated surfaces 42, 43 for fastening the batten to the stud.

At the center of the batten, between the flanges 68, there is defined a slot 74 that has a pair of inwardly protruding ribs 76 that match those 50 of the stud slots 34. As a result, one of the aforementioned covers 82 will also fit into and cover the batten slot 74 (See FIG. 3).

The parallel walls of the base 62 define a pair of shoulders 77. The shoulder pairs 77 are spaced apart by a distance somewhat greater than the width of the slots 74 and provide surfaces against which channel nuts bear as described more filly below.

Figure 4:
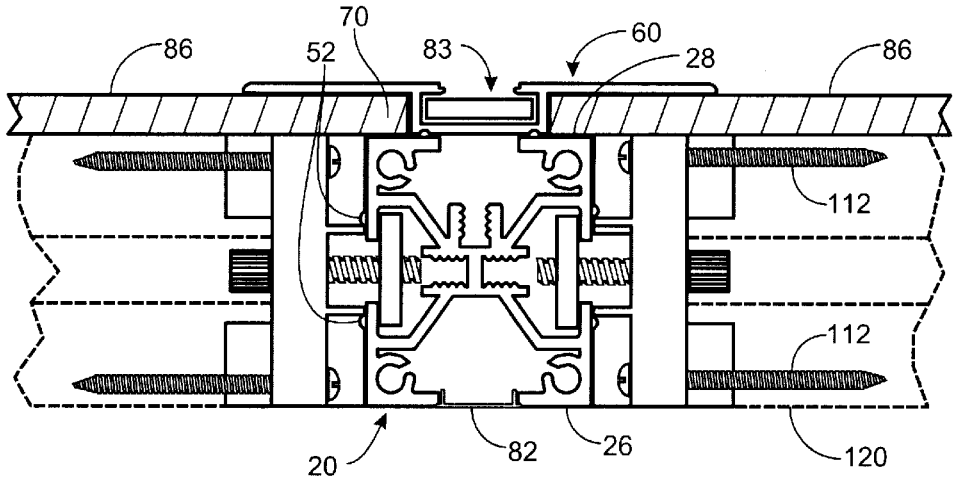
FIG. 4 is a cross sectional view of components of the cleanroom wall system at the junction of two horizontal studs and a vertical stud.
Figure 5:
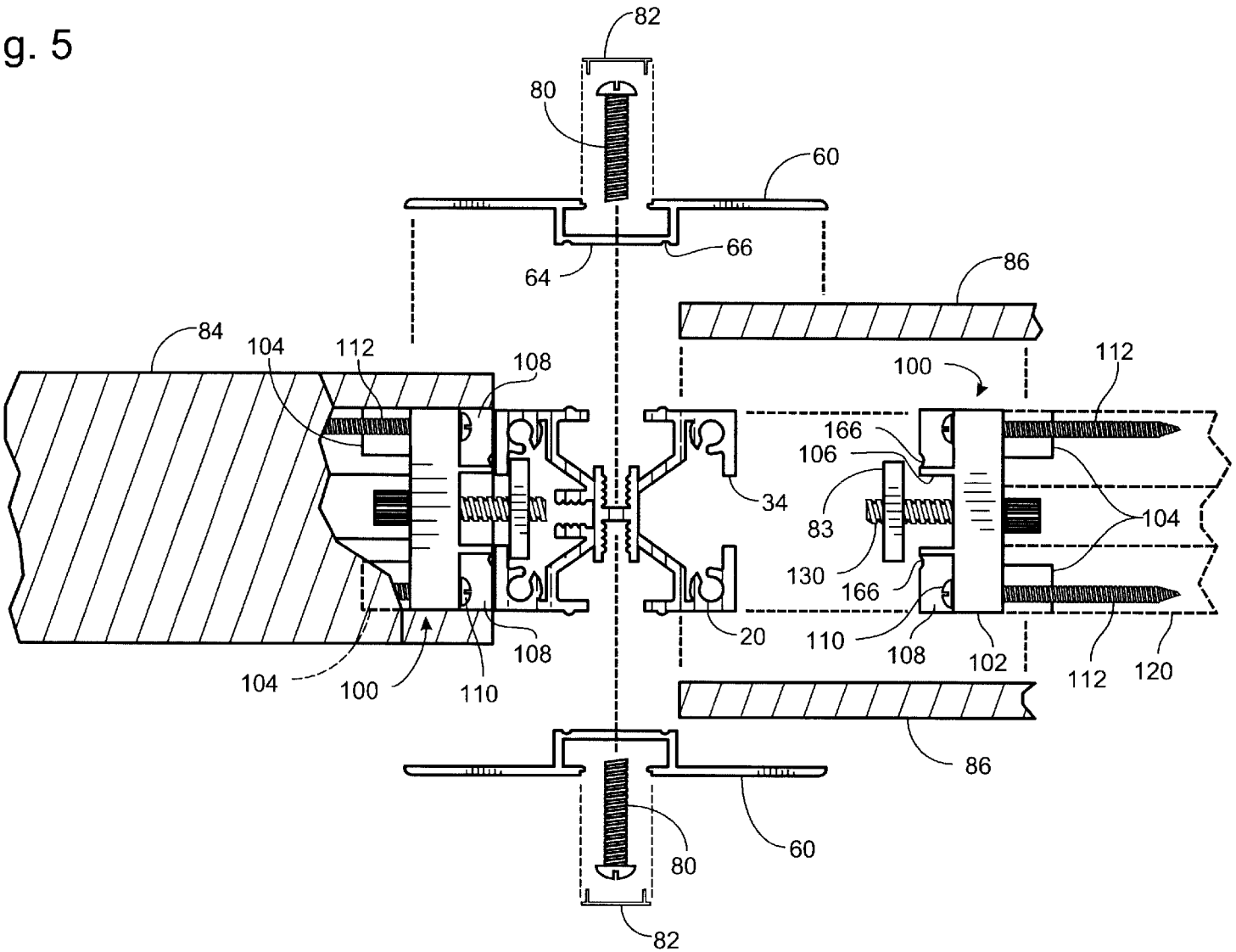
FIG. 5 is an exploded view of components of the cleanroom wall system invention at the junction of two horizontal studs and a vertical stud.
Figure 18:
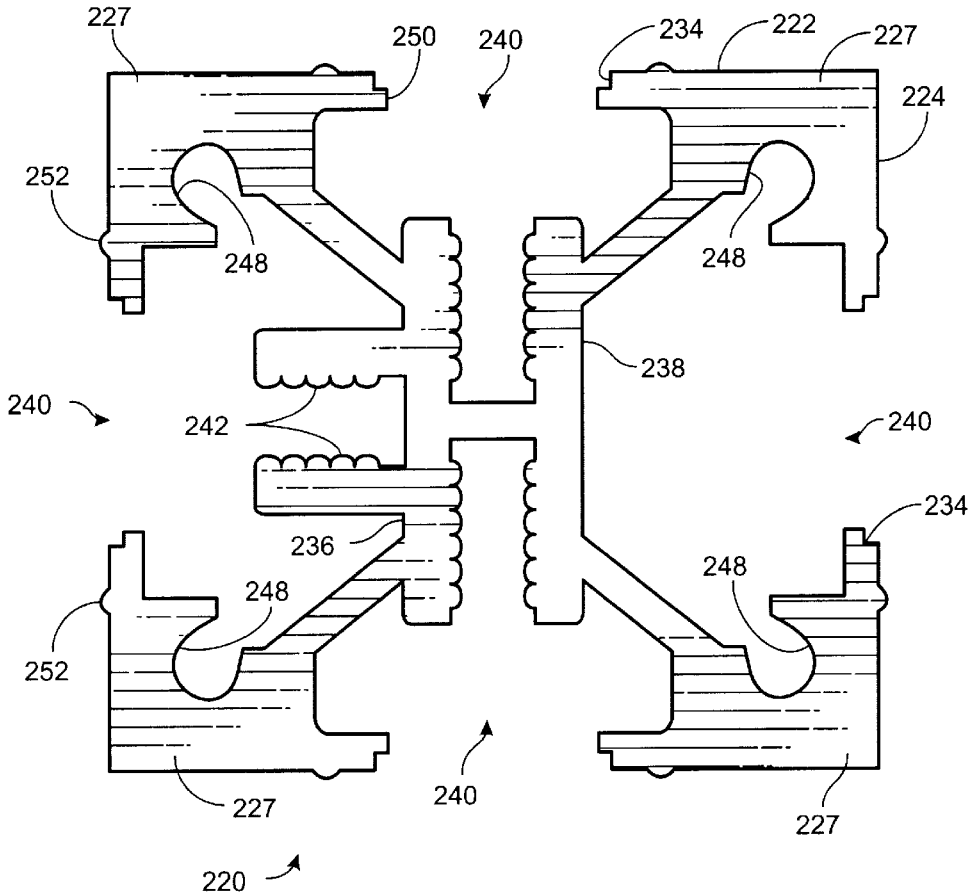
FIG. 18 is an end view of another embodiment of a stud component of a cleanroom wall system.

It is noteworthy here that, in a few respects, the stud component appearing in FIGS. 3–5 has been simplified somewhat for the purpose of clear illustration. Reference should be made to FIGS. 1 and 18 when it is necessary to scrutinize additional details of the stud configuration.

FIG. 3 shows the universal stud 20 of the present invention used in one of at least three different wall configurations. In particular, the components of the system are assembled so that two battens are mounted to the stud on the opposing walls 22, 26 that define the wide side 30 of the stud 20. As a result, the overall thickness of the wall secured to the combined battens and stud (as measured between the top to bottom of FIG. 3) is the sum of the width of the stud's narrow side 32 and the width of the two gaps 70. That sum appears as dimension "W" in FIG. 3. In a preferred embodiment, this sum is a nominal wall thickness of two inches (5.08 cm)

As shown on the left side of FIG. 3, a conventional "thick" wall panel 84 fits into and is retained between the batten flanges 68. That panel abuts the stud 20. The wall panel 84 may also rest on a horizontally connected stud 120, such as shown on the right side of FIG. 3. The horizontal stud 120 has the same cross sectional shape as the above-described stud 20.

The right side of FIG. 3 shows an arrangement whereby a pair of thin, spaced apart wall panels 86 (the "double-sided wall" arrangement mentioned above) are retained in the respective gaps 70 that are present between the batten flanges 68 and the outer walls 22, 26 of the stud. The connector block 100 and horizontal stud 120, which are also shown in FIG. 3, will be described below.

With respect to FIG. 3, it is noteworthy that the distance between the outermost edges of the flanges 68 of a batten (that is, measured horizontally in FIG. 3) is about 3 inches in the preferred embodiment shown. It is noted, however, that shorter-flange battens may be employed. For instance, a flange edge-to-edge distance of 2 inches would suffice, leaving an adequate extension of the flanges to secure wall panels between them.

FIG. 4 shows that, as compared to FIG. 3, the rectangular stud 20 has been rotated 90 degrees to accommodate using the same stud design another wall panel arrangement. This illustrates the universal aspect of the stud.

In particular, FIG. 4 shows a batten 60 mounted to the wall 28 of the stud that defines the narrow side 32 of the stud. (For illustrating how a channel nut 83 fits in both the stud and batten, the fasteners 80 that secure the batten to the stud are not shown in FIG. 4.) Only one side of the studs 20, 120 is covered with the thin-type wall panels 86, which may be, for example, 0.25 inches thick. As a result, the nominal wall thickness (here, 2 inches) is maintained even though the wall configuration calls for the "single sided wall" arrangement mentioned above.

It will be appreciated that the use of a universal stud 20, 120 to assemble at least three different wall arrangements greatly simplifies the construction and handling of the components.

FIGS. 5–8 are useful for illustrating the configuration and use of the connector block 100. One preferred connector block is shown in FIGS. 16 and 17 and is shaped for mounting on the end of a horizontally oriented stud 120 and for connection with a vertical stud in a manner that ensures a stiff connection between the two studs.

The connector block 100 includes a body 102 (FIGS. 5, 16, 17) that has a cross section that is sized to match the cross section of the stud. Thus, the outer surfaces of the connector block body are flush with the outer surfaces of the stud 120.

Figure 6:
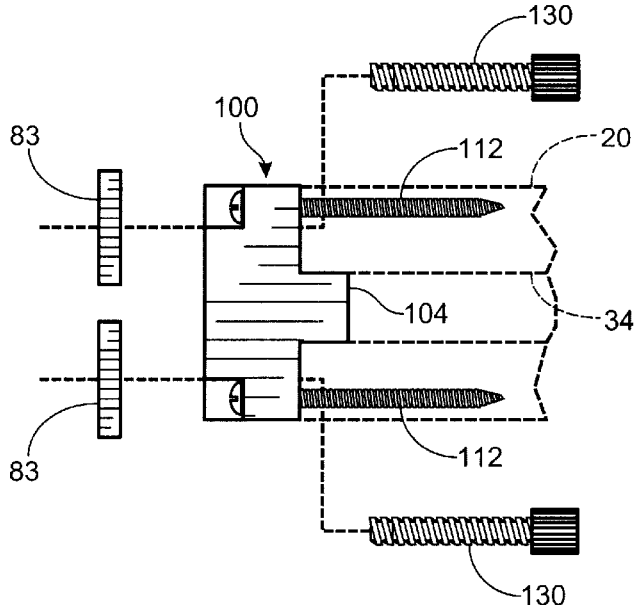
FIGS. 6–8 show in a sequence of three drawings how a connector block the cleanroom wall system is connected to the end of a stud and readied for connection with another stud that is oriented perpendicular to the first stud.
Figure 15:
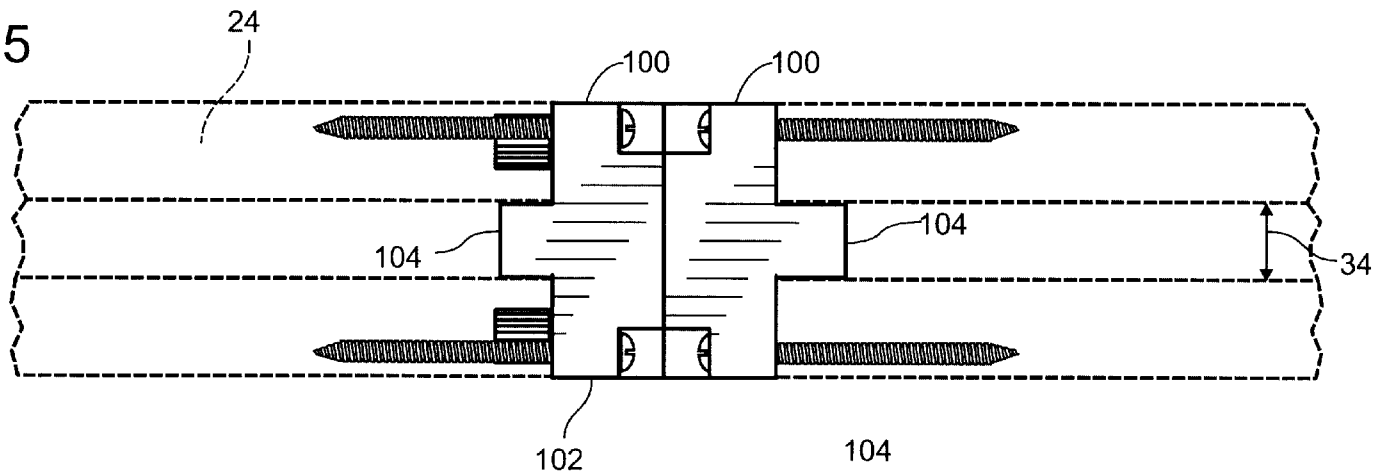
FIG. 15 is another side view, rotated 90 degrees relative to the view of FIG. 14, and showing the same splicing technique.

A pair of protrusions 104 protrude from one side of the block body. The protrusions 104 are spaced from each other and each is shaped to slide into a chamber 40 of a stud. The outer part of each protrusion fits snugly between the opposing edges of the slot 34 of the associated chamber, as best shown in FIGS. 6 and 15. The outer surface of the protrusion 104, as well as the outer surface of the body 102 is flush with the outer surface of the stud.

A cubical cut 108 is made in each corner of the side of the block body 102 that is opposite that of the protrusions 104. The corners have holes 109 to pass sheet metal screws 112 (FIG. 5), the heads 110 of which are recessed in the cuts 108. The screws thread into the apertures 48 made in the stud as described above (FIG. 1). Thus, the screws 112 firmly attach the block 100 to the end of a stud. The snug fitting protrusions 104 in the stud slots 34 further stiffen the junction. The connection to the stud end is made with a block that is no larger in cross sectional area than that of the stud.

An elongated recess 106 is formed in the side of the connector body that is opposite the protrusions (FIG. 5). This block surface also has a pair of parallel grooves 166 that match in size and orientation the grooves 66 formed on the underside 64 of the batten 60. Thus, as best shown in FIG. 4, the connector block grooves 166 mate with the ridges 52 on the stud 20 to facilitate precise alignment of the studs when a horizontal and vertical stud are brought together for making a joint.

The connector block 100 includes two spaced-apart holes 129 to accommodate cap screws 130 (FIG. 6). The shafts of the screws 130 extend out of the block recess 106, and the heads of the screws fit into a chamber 40 in the stud when the block is fastened to the stud by the sheet metal screws 112.

Figure 7:
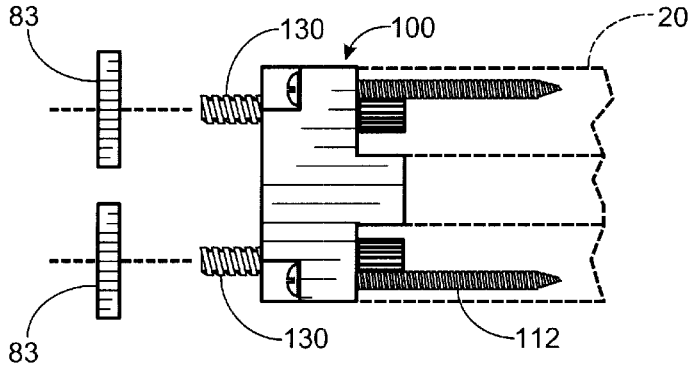
Figure 8:
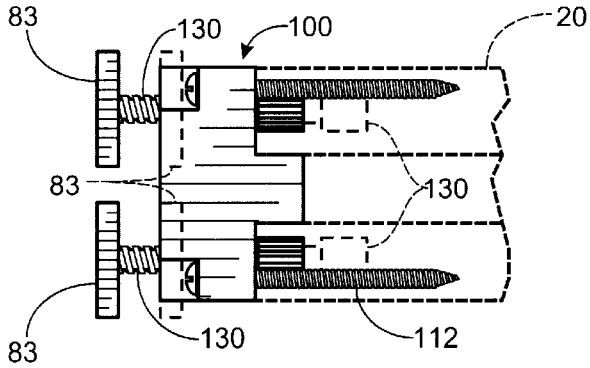
Figure 9:
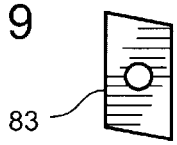
FIGS. 9 and 10 are a plan and side view, respectively, of a channel nut that is useful for both connecting together studs and for securing items to the batten.
Figure 10:
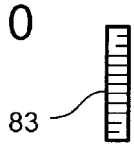

A channel nut 83 (shown in plan, FIG. 9 and side, FIG. 10) is threaded to the exposed end of each screw 130 (FIG. 5). As such, the assembly of the horizontal stud 102 and connector block is ready for joining to a vertical stud 20. FIGS. 6–8 show in a sequence of three drawings how a connector block 100 of the present system is connected to the end of a stud and readied for connection with another stud by locating the cap screws 130 and threading the channel nuts 83 onto the shafts of the screws.

Figure 11:
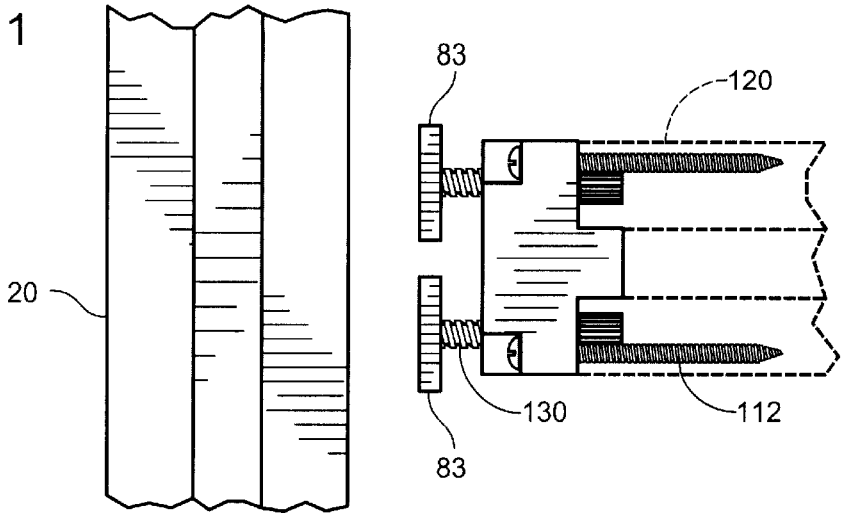
FIGS. 11–13 show in a sequence of three drawings how one stud is connected with another stud that is oriented perpendicular to the first stud.
Figure 12:
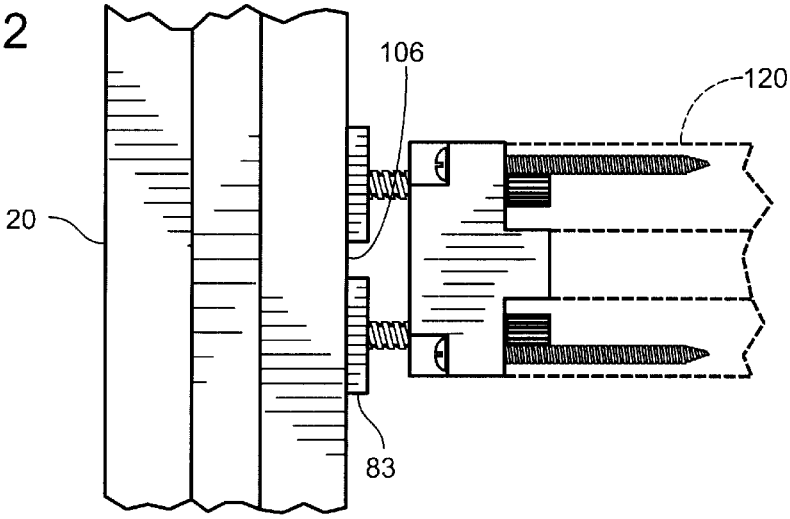
Figure 13:
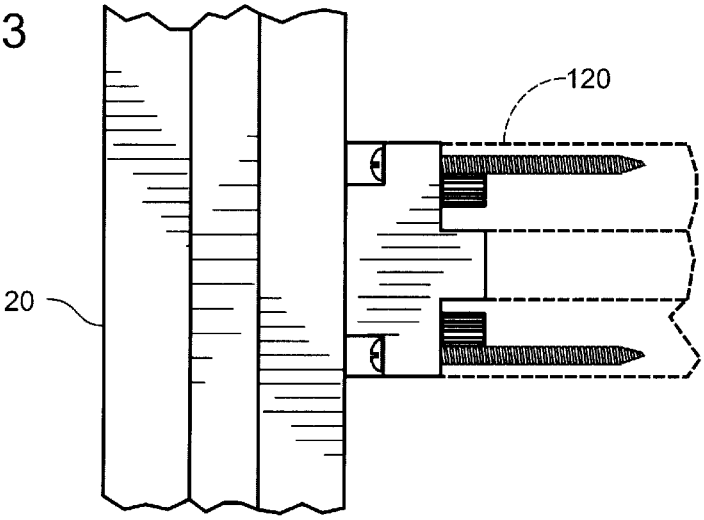

The channel nuts 83 are rotated by an amount sufficient to permit them to pass through the slot 34, thereby to be inserted in the chamber 40 of the stud 20. (The nuts 83 in the right half of FIG. 5 are shown prior to such rotation.) Once inserted, the nuts are rotated until they bear against the shoulders 46, whence the screws 130 are tightened to complete the connection (See FIGS. 4 and 13). FIGS. 11–13 are a sequence of three drawings showing the just described method of connecting one stud 120 with another stud 20 that is oriented perpendicular to the first stud.

The batten 60 and stud 20 are sized so that a single size of channel nut 83 can be used both for connecting studs (as just described) and for connecting items to the batten. With respect to the latter, FIG. 4 shows a channel nut 83 fit into the batten, ready to receive the end of a threaded fastener that may be used, for example, to connect a shelf to a wall panel.

It is noteworthy here that the recess 106 in the connector block 100 is sized to receive the channel nuts 83 that are threaded on the screws 130. In this regard, the nuts may be retracted into the recess 106 so they do not protrude from the block. This retracted position is shown in dashed lines of FIG. 8. It will be appreciated that the retraction feature reduces clearance requirements during assembly (since an unconnected beam and connector block assembly is not longer than a connected beam and connector block assembly) and, thus, greatly facilitates moving, for example, a horizontal stud into position between two fixed vertical studs prior to joining the horizontal stud to them.

As noted earlier, a pair of connector blocks may be employed for splicing together two axially aligned studs, such as two parts of a vertically oriented stud. The splicing aspect of the connector block enables simple construction and remodeling of wall systems in instances where only a portion of the wall between the ceiling and floor need be changed.

Figure 14:
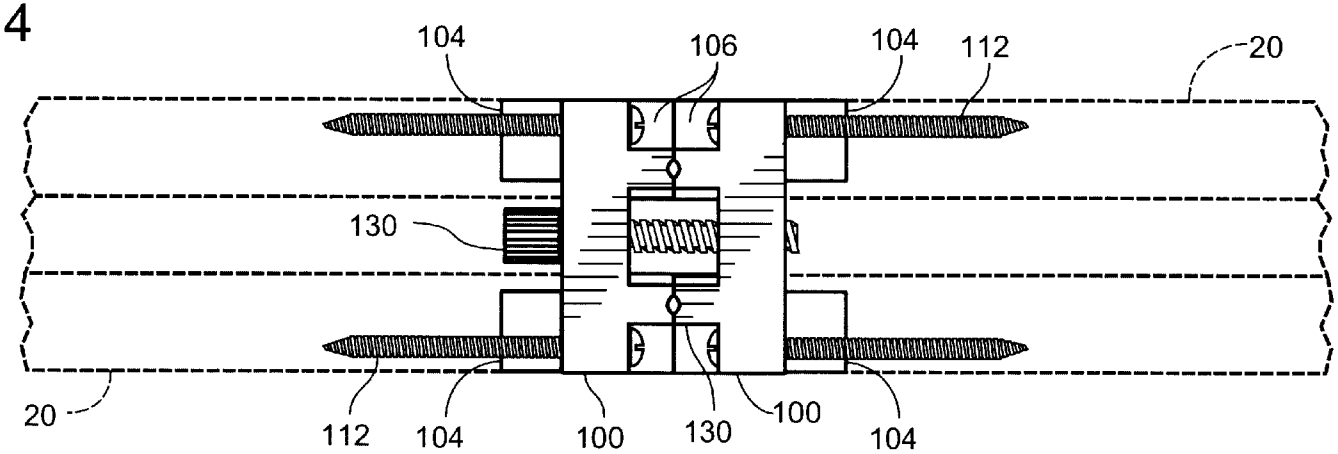
FIG. 14 is a side view of a pair of studs that are spliced together in accordance with the present invention.

As shown in FIGS. 14 and 15, this splicing is accomplished by abutting together the ends of two studs 20 that have connector blocks 100 fastened to them in the manner described above. In one embodiment, one of the blocks is modified by threading the normally clear holes 129. Once the studs are aligned, the screws 130 passing though one block are threaded into the correspondingly threaded holes on the other block to fix the junction. The screws 130 may have Allen-type heads so that they are tightened with an Allen wrench that fits through the adjacent slot 34 in the stud.

While the present invention has been described in terms of a preferred embodiment, it will be appreciated by one of ordinary skill that modifications may be made to alter or supplement the components.

For example, FIG. 5 shows the connection of a narrow side of a vertical stud to the narrow side of the horizontal stud, along with a suitable connector block. A substantially similar connector block would be used in instances requiring the connection of wide side of a vertical stud to the wide side of the horizontal stud. Such a block, however, would be modified slightly so that the recess 106 extends parallel to the short sides of the block. The protrusions 104 would be realigned accordingly, to fit into the appropriate chamber in the stud.

FIG. 18 is an end view of another stud component of the wall system, which stud can be used in the assembly of the present invention. That stud 220, in many respects (such as its universal side widths) is substantially similar to the stud 20 of FIG. 1. The last two digits of the three-digit reference numbers applied to FIG. 18 correspond to the reference numbers of similar stud features as described in connection with FIG. 1.

The embodiment of FIG. 18 includes, as compared to FIG. 1, more metal in the corners 227. The apertures 248 are spaced about one-diameter's length from the outer corner walls of the stud. This, along with thickened horizontal and vertical parts (that is, horizontal and vertical as viewed in FIG. 18) of the inner walls 236, 238 enhances the stud's resistance to deflection along its length.

Figure 19:
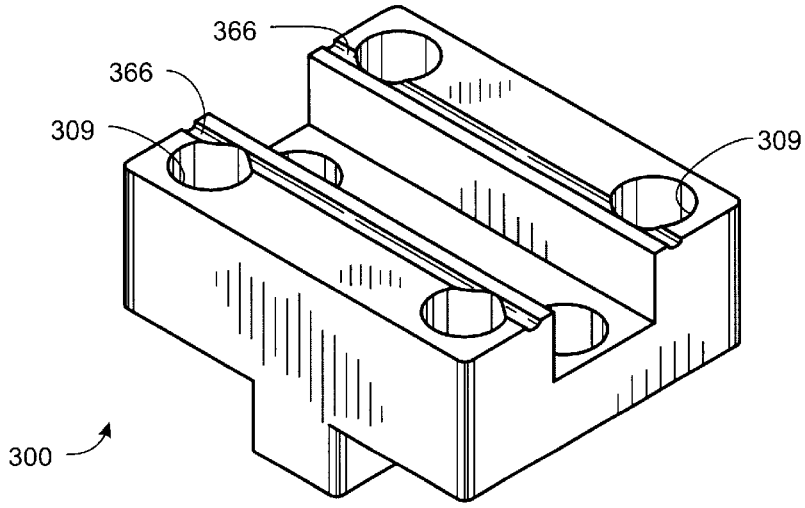
FIG. 19 is a perspective view of one side of an alternative connector block configured for use with the stud embodiment of FIG. 18.

FIG. 19 shows one side of a connector block 300 that is used with the stud embodiment of FIG. 18. This block substantially matches the block 100 described above, but for the region surrounding the holes 309 for the sheet metal screws. Those holes 309 are centered with apertures 348, which, as noted, are more distant from the corners of the stud 220. As a result, the holes 309 are countersunk into the surface 310 of the block, thereby obviating the need for the cubical cut 108 described above. The heads of the sheet metal screws 112 will reside substantially out of view in the countersunk portion of the holes 309.

Figure 20:
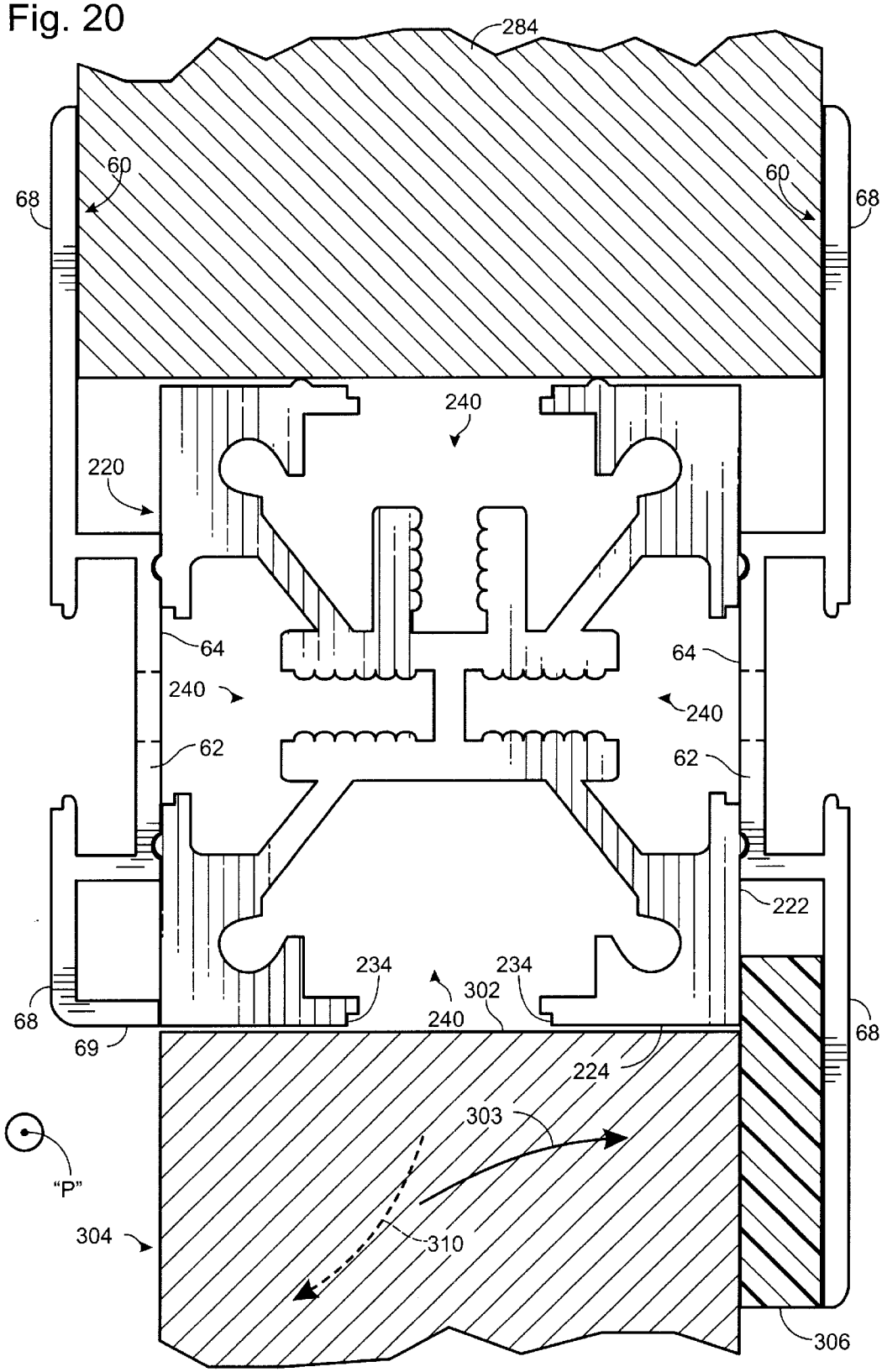
FIG. 20 is a sectional view of a stud that is oriented for use as a doorjamb component of the assembly of the present invention.

FIG. 20 illustrates how a stud 220 having a cross section matching that shown in FIG. 18 can be used for the purpose of framing a door, thereby eliminating the need for a separate doorframe component. As just used, the term "separate" means a component that has a cross sectional shape unlike the cross sectional shape of the stud 220, which stud 220 is also used as a wall stud as described above.

In particular, the stud 220 depicted in FIG. 20 is shown in end view as the stud is employed as part of a doorframe, specifically, as a doorjamb. For convenience, a stud so used (that is, as a doorjamb or as a door header, as described below) will hereafter sometimes be referred to as a door stud, to distinguish the stud from instances when the same-shaped stud 220 is used as a wall stud. Put another way, the studs are the same shape, but for convenience of description are given different names when used in different ways.

At the top of FIG. 20 there is shown a conventional wall panel 284 that matches the thick panel 84 described in connection with FIG. 3 above. The edge of the panel 284 is enclosed between the flanges 68 of two battens 60, which were generally described above in connection with FIG. 2. It will be appreciated that one side of the stud 220 shown in FIG. 20 (that is, the side adjoining the wall panel 284) serves as a wall stud for securing the wall panel 284 in a manner as described above.

The side of the stud 220 that is opposite the wall panel 284 (FIG. 20) is adjacent to the edge 302 of a door 304. That is, the outer wall 224 of that stud 220 defines the vertical surface of a doorway within which fits the door 304. In FIG. 20, the free edge 302 (that is, opposite to a hinged edge) of the door is depicted. The door swings closed in the direction of the arrow 303. A compressible gasket 306 is carried on the inner surface of the batten flange 68 that slightly protrudes into the doorway. The gasket 306 engages the closed door 304 to seal the side of the door in the doorway.

The batten flange 68 that is opposite to the flange that carries the gasket 306 is shortened and shaped to have a ninety-degree bent part 69 that extends to the stud outer wall. This batten configuration provides clearance for the door 304 as the door is opened (that is, as the door is moved in the direction opposite that indicated by arrow 303).

It will be appreciated that the gasket-carrying flange 68 may not be needed, and a batten flange having a ninety-degree bent part 69 may be used on both sides of the door 304, thereby allowing a two-way swinging door in the doorway. Also, a cover 82, such as described above in connection with FIG. 4 may be located in the slot 234 that faces the door edge 302, thereby providing an overall flush outer surface of the wall 224 that is adjacent to the door.

On the other hand, the slot 234 in the stud 220 could be left open to serve as a stop hole that receives a door lock bolt as the door moves into the closed position. Part of the outer wall 224 of the stud 220 thus serves as a strike plate. In any event, it will be appreciated that the need for a separately configured doorjamb member is eliminated by the used of the stud 220 as just described. The door is mounted to the same type (that is, same cross sectional shape) of stud that also supports the wall panels.

While FIG. 20 depicts the free edge 302 of the door, it will be appreciated that the stud 220 will also serve to frame the door at the hinged edge of the door. In this regard, a pivot point "P" is illustrated in FIG. 20 to show the possible relative location of a vertical axis (into and out of the plane of FIG. 20) about which a hinged door would swing if the hinged end of the door were mounted to the stud shown in FIG. 20. The door would swing about the pivot "P" in the direction shown by the dashed arrow 310, and engage the gasket 306 when the door is closed. Thus, two of the studs that are used for supporting the wall panels may also serve to frame opposite vertical edges of a door, thereby replacing the need for separate doorjambs.

The same stud shape that can serve as a wall stud or as a doorjamb as just described can also serve as a lintel or header that frames the top of the door. This is illustrated in FIG. 21, discussed next.

Figure 21:
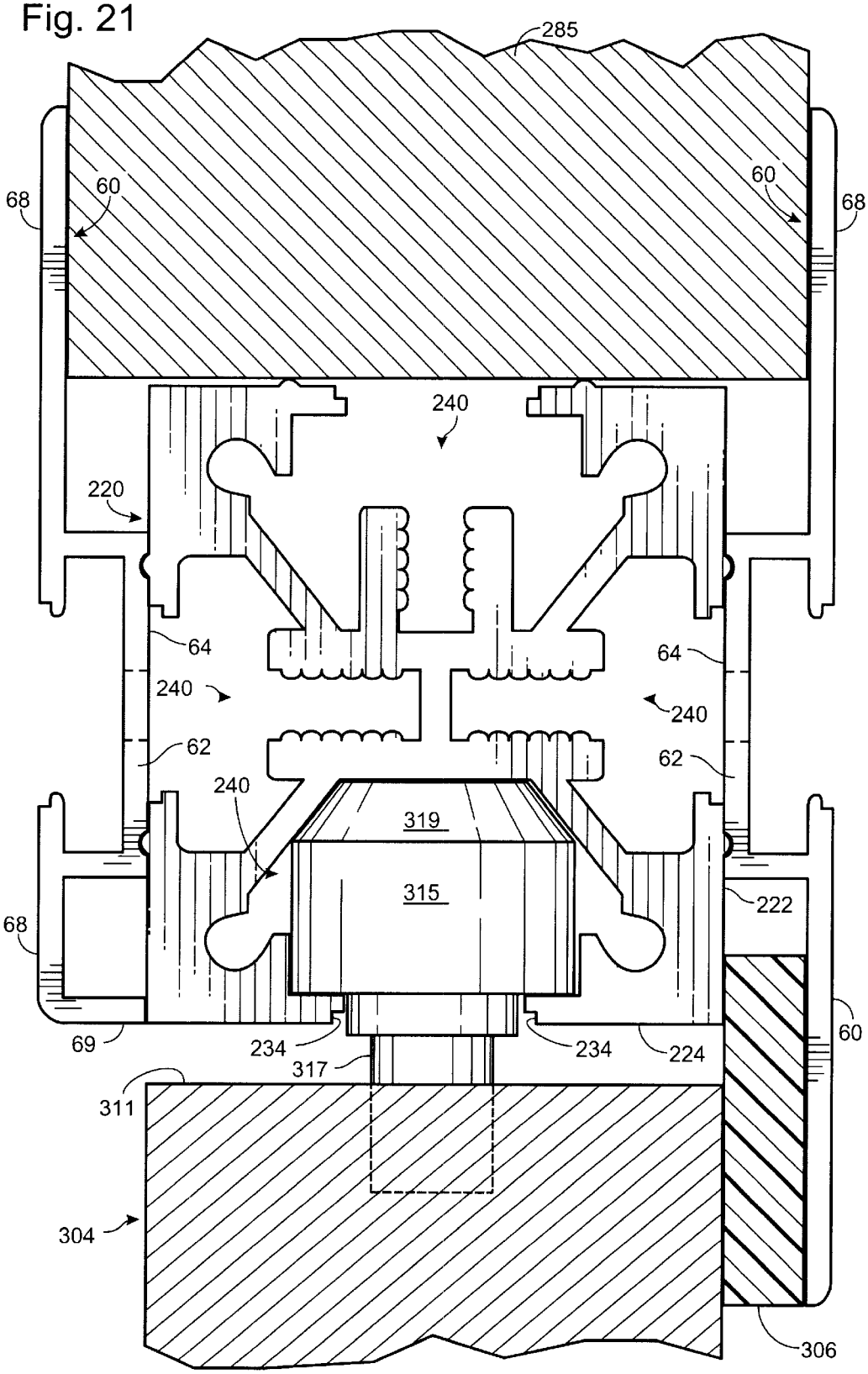
FIG. 21 is a sectional view of a stud that is oriented for use a door header component of the assembly of the present invention.

FIG. 21 depicts the stud 220 oriented to serve as a substitute for a separate doorframe header member. In this regard, the top edge 311 of the door 304 swings into position under and adjacent to the outer wall 224 of the stud. As described above in connection with FIG. 20, the stud 220 as a door header (FIG. 21) may include battens 60, one with a flange 68 having attached gasket 306, and the other with a flange having a ninety-degree bent part 69.

As depicted in FIG. 21, the stud 220 is oriented so that the one of four chambers 240 having no corrugated surfaces (such surfaces shown at 242 in FIG. 18) opens toward the top 311 of the door 304. Within that chamber fits a door closure guide 315 that is part of a conventional hidden door closure that is mounted to the top of the door 304. In one preferred embodiment, the guide 315 is rotatably mounted to a shaft 317 that extends between the guide 315 and the closure (not shown).

The guide 315 protrudes from the top 311 of the door and generally corresponds to the shape of the chamber 240 within which it fits. In particular, the guide 315 is generally cylindrically shaped but for a chamfered upper end 319. The guide 315 rolls along the length of the interior surface that defines the chamber 240 as the door is opened and closed, this movement providing a moving pivot point for the closure. Preferably, the guide 315 is made of durable, low-friction material, such as that sold under the trademark DELRIN by Du Pont.

The outer wall of the stud 220 that is opposite the wall 224 that faces the door 304 supports a conventional wall panel 285 that matches the thick panel 84 described in connection with FIG. 3 above. The edge of the panel 285 is enclosed between the flanges 68 of the two battens 60. It will be appreciated that one side of the stud 220 shown in FIG. 21 (that is the side adjoining the wall panel 285) serves as a wall stud for securing the wall panel 285 as described above.

In summary, the use of the wall stud 220 for framing a door (doorjambs and header) eliminates the need for additional, conventional door framing components. Moreover, when used as a header, the door stud 220 accommodates a guide for a hidden door closure as described above. As noted, the stud 220 used for these purposes is the same design as the stud used purely as a wall stud.

In view of the variations and modifications appreciable to one of ordinary skill, the invention is considered to be that described in the language of the appended claims and equivalents.

What is claimed is:

1. A method of mounting a door in a doorway of a wall that has metal wall studs, wherein the wall studs have a predetermined cross sectional shape, and wherein the wall studs support wall panels, the method comprising the steps of:

locating door studs along two sides and the top of the doorway thereby to define the doorway with three door studs having the same cross sectional shape as the wall studs;

attaching to the top of the door a closure member tat includes a part that protrudes from the top of the door;

inserting the protruding part into a chamber in the door stud that is at the top of the doorway; and mounting the door to the door studs.

2. The method of claim 1 including the step of:

providing the protruding part to be a rotatable member.

3. The method of claim 1 including the steps of:

attaching a flanged batten member to each of the door studs; and providing on the flange a gasket member for sealing the door in the doorway.

4. The method of claim 1 including the step of attaching wall panels to the door studs that are located along the two sides and the top of the doorway so that the door studs serve both as wall studs and for framing the door.

5. A wall and door assembly, comprising:

metal wall studs having a first cross sectional shape;

wall panels attached along first edges of the wall panels to opposing sides of the wall studs;

a pair of metal door studs attached to a second edge of a wall panel and defining a doorway, the door studs having the first cross sectional shape;

a metal header door stud having the first cross sectional shape and extending between the door studs;

a door that is fit in the doorway adjacent to the door studs and the header door stud so that the door studs provide a frame for door; and a closure member carried by the door and extending into the header door stud.

6. The assembly of claim 5 including a wall batten fastened to the wall stud to cover the first edge of a wall panel, the wall batten having a cross sectional shape; and a flanged door batten fastened to a metal door stud and having the same cross sectional shape as the wall batten, the door batten including a gasket for sealing the door in the doorway.

* * * * *